United States Patent [19]

Suzuki et al.

[11] Patent Number: 5,046,394

[45] Date of Patent: Sep. 10, 1991

[54] MUSICAL TONE CONTROL APPARATUS

[75] Inventors: Hideo Suzuki; Jun Sugiyama, both of Hamamatsu, Japan

[73] Assignee: Yamaha Corporation, Hamamatsu, Japan

[21] Appl. No.: 410,291

[22] Filed: Sep. 21, 1989

[30] Foreign Application Priority Data

Sep. 21, 1988 [JP] Japan ..... 63-236835

[51] Int. Cl.[5] ..... H01J 5/16

[52] U.S. Cl. ..... 84/600; 84/670; 84/718; 250/227.14; 385/1; 385/13

[58] Field of Search ..... 84/658-670, 84/687-690, 724, 600-601; 250/227.14, 227.16, 231.19; 350/96.15

[56] References Cited

U.S. PATENT DOCUMENTS

| | | | |
|---|---|---|---|
| 4,519,671 | 5/1985 | Curtis et al. | 350/96.15 |
| 4,542,291 | 9/1985 | Zimmerman | 250/231.1 |
| 4,627,324 | 12/1986 | Zwosta | 84/687 X |
| 4,633,079 | 12/1986 | Rieger | 250/227.14 |
| 4,635,516 | 1/1987 | Giannini | 84/1.01 |
| 4,655,114 | 4/1987 | Sunada | 84/626 |
| 4,920,848 | 5/1990 | Suzuki | 84/658 X |

FOREIGN PATENT DOCUMENTS

| | | |
|---|---|---|
| 87114944.9 | 10/1987 | European Pat. Off. . |
| 63-127773 | 5/1988 | Japan . |

*Primary Examiner*—William M. Shoop, Jr.
*Assistant Examiner*—Brian Sircus
*Attorney, Agent, or Firm*—Spensely Horn Jubas & Lubitz

[57] ABSTRACT

The musical tone control apparatus generates a musical tone control signal in response to a motion at a certain part of a human body, preferably a bending motion at an articulation of a finger, wherein it includes a light emitting element, a photo-conductive member and a light receiving element. The light emitted from the light emitting element is transmitted through the photo-conductive member whose light transmission rate varies in response to the force applied thereon, so that the amount of the light transmitted through the photoconductive member is reduced. Such reduced amount of the transmitted light is received by the light receiving element. Based on the received light, the musical tone control signal is generated. Thus, by bending the photoconductive member, the musical tone control signal can be varied. Preferably, the light emitting element is a photodiode, the photo-conductive member is an optical fiber, and the light receiving element is a phototransistor.

17 Claims, 6 Drawing Sheets

MUSICAL TONE CONTROL APPARATUS

BACKGROUND OF THE INVENTION

1. Field of the Invention

The present invention relates to a musical tone control apparatus, and more particularly to a musical tone control apparatus which outputs a musical tone control signal in response to a motion of a human body.

2. Prior Art

For example, Japanese Patent Laid-Open Publication No. 63-127773 discloses the conventional musical tone control apparatus which provides a potentiometer at an articulation (or joint portion) of the human body or pressure-sensitive element at a tip end of a finger. Then, the resistance of this potentiometer varies in response to a bending motion of the articulation, while the resistance or output voltage of this pressure-sensitive element varies in response to a bending motion of the finger. By detecting such bending motion of the articulation or finger, this apparatus outputs the musical tone control apparatus for controlling a musical tone.

However, the above-mentioned apparatus using the potentiometer is disadvantageous in that the size thereof becomes larger. So, it is difficult for the performer is hard to move his body when putting on such potentiometer. Meanwhile, the relation between the pressure-sensitive element and the bending motion of the finger is not so strong, so that it is impossible to obtain the musical tone control signal sufficiently corresponding to the bending motion of the finger. In the case where the on/off is carried out on the musical tone generation, this element works well. However, this el is not suitable to generate the delicate musical tone control by which a tone pitch, tone color, tone volume etc. of musical tone are continuously controlled.

SUMMARY OF THE INVENTION

It is accordingly a primary object of the present invention to provide musical tone control apparatus which can detect the bending motion of some part of the human body so that the musical tone control signal to be generated will correspond to the bending motion of some part of the human body with high sensitiveness.

It is another object of the present invention to provide a musical tone control whose size can be reduced so that the performer can move freely even if he puts on this apparatus at some of his body.

In a first of the present invention, there is provided a musical control apparatus comprising:

(a) a light element;

(b) a photo-conductive member, in which a transmission amount of a light from the light emitting element varies in response to the photo-conductive member; and (c) a light receiving element for receiving the light transmitted through photo-conductive member, at least the photo-conductive member being attached to a mounting member which is to be mounted to a certain portion of a human body, whereby a musical tone control signal is generated in response to an amount of the light received by the light receiving element.

In a second aspect of the present invention, there is provided a musical tone control apparatus comprising:

(a) a photocoupler capable of emitting and receiving a light, the photocoupler generating a signal corresponding to a received light thereof;

(b) first and second optical fibers which are to be connected in series;

(c) a connector which can be closed or opened by a desirable degree in response to a motion at a certain part of a human body, the first and second optical fibers being connected together in series by the connector, so that an amount of the light transmitted through the optical fibers is varied in response to the motion;

(d) reflection member provided at one edge of the second optical fiber which is not connected to the connector; and (e) musical tone control means for generating a musical tone control signal based on an output signal of the photocoupler, wherein the photocoupler is coupled at one edge of the first optical fiber which is not connected to the connector, the photocoupler, the first optical fiber, the connector, the second optical fiber and the reflection member are connected in series so that the light emitted from the photocoupler is transmitted through the first optical fiber, the connector, the second optical fiber and then it is reflected by the reflection member, in which a reflected light is transmitted through the second optical fiber, the connector, the first optical fiber and then received by the photocoupler, the photocoupler outputting its output signal in response to the reflected light which is received by the photocoupler, whereby the musical tone control signal is varied in response to the output signal of the photocoupler based on the motion at the certain part of the human body.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF A PREFERRED EMBODIMENT

Figure 1:
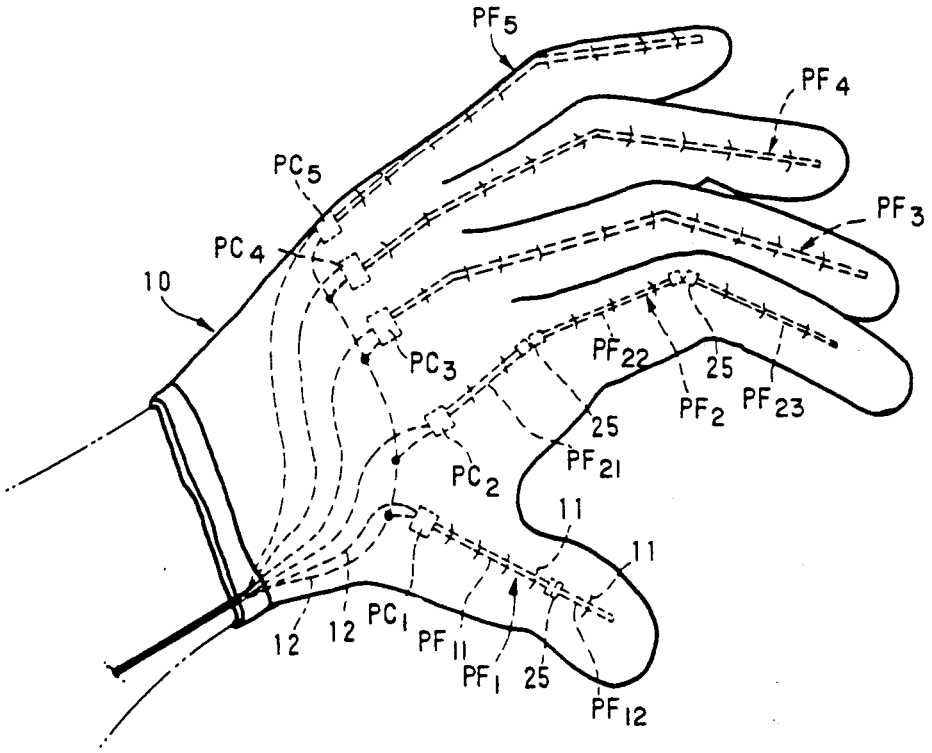
FIG. 1 is a perspective view showing a glove providing with a musical tone control apparatus according to an embodiment of the present invention.

[A] CONFIGURATION AND OPERATION OF A PREFERRED EMBODIMENT (1) Configuration of a preferred embodiment Referring now to the drawings, wherein like reference characters designate like or corresponding parts throughout the several views, FIG. 1 is a perspective view showing a glove 10 in which the musical tone control apparatus according to an embodiment of the present invention is provided.

This musical tone control apparatus includes optical fibers PF1 to PF5 each arranged along with each finger portion of the glove 10; and photocouplers PC1 to PC5 each connected to an edge portion of each of these optical fibers PF1 to PF5. Each optical fiber is fixed at several points of each finger portion of the glove 10 by fine strings 11, ... Each photocoupler is coupled to the externally provided electric circuit via a lead 12.

Figure 2:
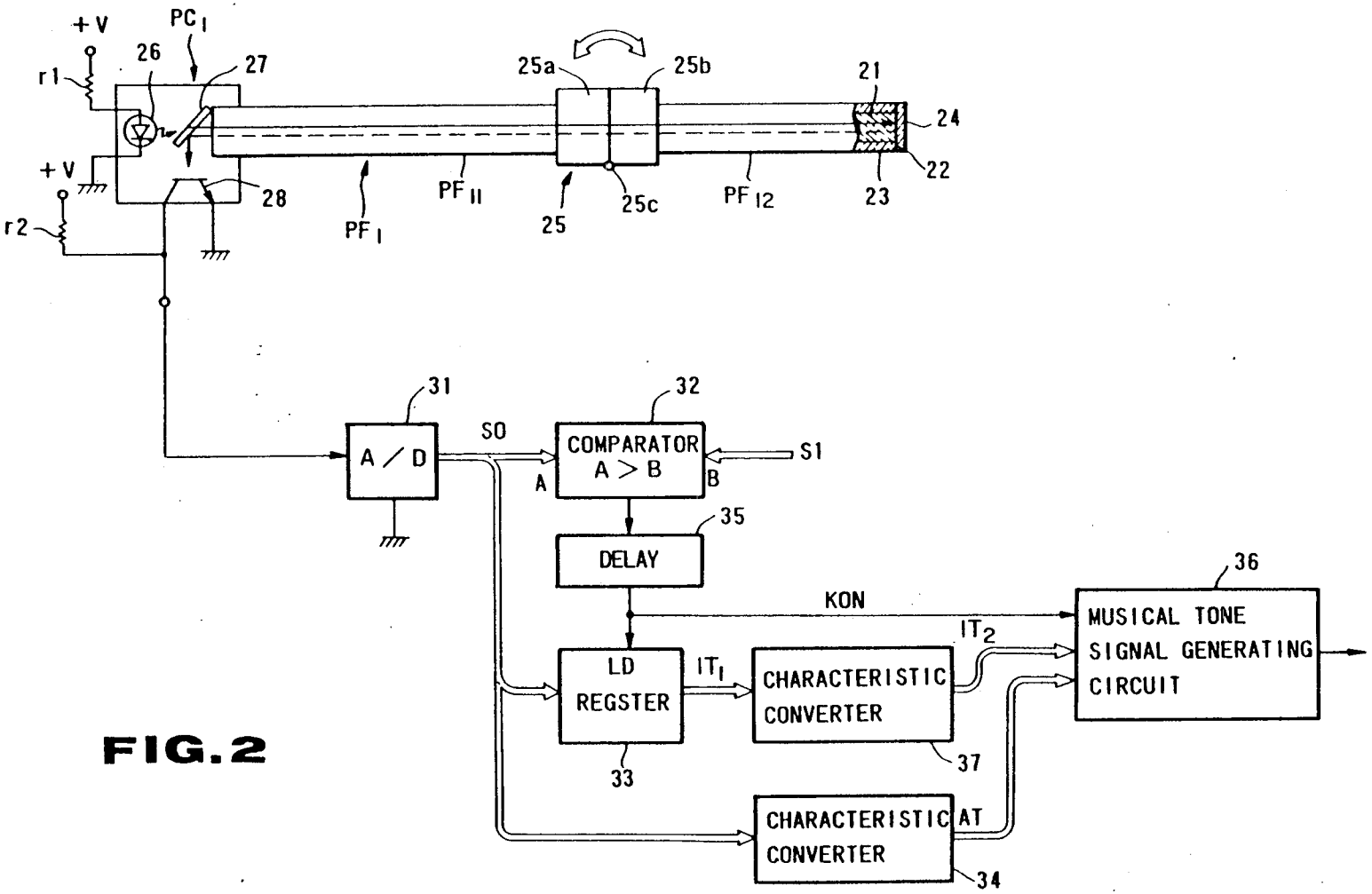
FIG. 2 is a block diagram showing an electric configuration of the musical tone control apparatus according to an embodiment.
Figure 3:
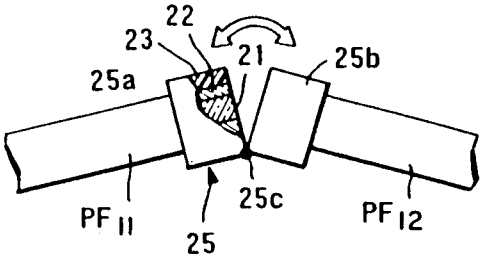
FIG. 3 is a partially broken view showing a connector illustrated in FIG. 2.

The optical fibers PF1, PF2 have the same construction. For example, as shown in FIGS. 2 and 3, this optical fiber PF1 is constructed by a core 21 having the fine and long cylindrical shape and whose refractive index is relatively high; a clad 22 having a low refractive index which is provided on the periphery of this core 21; and a coating member 23 which is made by the non-optical-transmission and non-optical-absorption materials, by which the periphery of the clad 22 is coated so that the clad 22 does not leak and absorb the light. At this end of the optical fiber PF1 opposite to the photocoupler PC1, a reflection plate 24 is provided. This optical fiber PF1 is divided into two parts, i.e., a first optical fiber part PF11 and a second optical fiber part PF12. These two parts PF11 and PF12 are connected together by a connector 25. This connector 25 is constructed by first and second connector members 25*a*, 25*b* each having a cubic shape, and a hinge 25*c*. The connector members 25*a*, 25*b* are respectively fixed at edge portions of the optical fiber parts PF11, PF12. The hinge 25*c* is provided at one portion where the connector members 25*a*, 25*b* are to be joined together. Thus, the connector members 25*a*, 25*b* can be revolved around the hinge 25*c* in the direction rectangular to axial directions of the optical fiber parts PF11, PF12.

The photocoupler PC1, as shown in FIG. 2, consists of a photodiode 26, a half mirror 27 and a phototransistor 28. The anode of the photodiode 26 is connected to a power source (+V) via a resistor r1, while the cathode thereof is grounded. This photodiode 26 is designed to emit the infrared ray therefrom. The half mirror 27 is arranged between the photodiode 26 and the edge portion of the optical fiber PF1, wherein one edge thereof is attached to one edge portion of the optical fiber PF1 to be inclined by 45 degrees. The infrared ray emitted from the photodiode 26 is transmitted through the half mirror 27 and then introduced into the optical fiber PF1. In addition, this half mirror 27 reflects the infrared ray from the optical fiber PF1 so that the reflected infrared ray is introduced to the phototransistor 28. The collector of this phototransistor 28 is connected to the power source (+V) via a resistor r2, while the emitter thereof is grounded. In response to the infrared ray received at the base of the phototransistor 28, the phototransistor 28 outputs the corresponding signal from its collector.

The collector of the phototransistor 28 is connected to an analog-to-digital converter (denoted to as A/D converter) 31 wherein the analog signal from the phototransistor 28 is converted into the digital signal SO, which is then fed to a comparator 32, a register 33 and a characteristic converter 34. The comparator 32 compares the digital signal SO with the predetermined value S1 which is relatively small. In case of S0>S1, the output level of the comparator 32 becomes high. Such output signal of the comparator 32 is fed to a delay circuit 35, which delays this signal to generate a key-on signal KON. This key-on signal KON is fed to a musical tone signal generating circuit 36 and a load input LD of the register 33. In synchronism with leading edge of the key-on signal KON fed to the load input LD, the register 33 fetches and stores the digital signal SO from the A/D converter 31. Such stored digital signal SO is fed to a characteristic converter 37 as an initial-touch signal IT1. The characteristic converter 37 converts the data indicated by the initial-touch signal IT1 into the desirable initial-touch characteristic, which is then outputted to the musical tone signal generating circuit 36 as an initial-touch signal IT2. Another characteristic converter 34 converts the digital signal S0 into an after-touch signal AT indicative of the desirable after-touch characteristic. This after-touch signal AT is fed to the musical tone signal generating circuit 36. In response to these key-on signal KON, initial-touch signal IT2 and aftertouch signal AT, the musical tone signal generating circuit 36 generates the desirable musical tone signal.

(2) Operation of a preferred embodiment

Next, description will be given with respect to an operation of the present embodiment as shown in FIGS. 1 to 3. In the case where the thumb is stretched as shown in FIG. 1, the optical fiber PF1 is in the state as shown in FIG. 2 wherein the connector 25 is closed so that the edge portions of the first and second optical fiber parts PF11, PF12 are connected together. In such state, the infrared ray emitted from the phototransistor 26 is introduced into the optical fiber PF1 via the half mirror 27 so that most of the infrared ray is transmitted through the optical fiber PF1 and then reached at the reflection plate 24. Thus, the infrared ray is reflected by the reflection plate 24, and then the reflected infrared ray is transmitted through the optical fiber PF1 and reaches the half mirror 27. This infrared ray is reflected by the half mirror 27, and then the reflected infrared ray is radiated to the base of the phototransistor 28. In this case, most of the infrared ray emitted from the photodiode 26 is finally fed to the phototransistor 28, so that the phototransistor 28 is turned on at high rate. Therefore, the voltage level at the input of the A/D converter 31 becomes low. Thus, the A/D converter 31 outputs the digital signal SO indicative of such low level, so that the output level of the comparator 32 remains at the low level. As a result, the delay circuit 35 supplies the key-on signal KON of low level, which avoids the generation of the musical tone signal from the musical tone signal generating circuit 36.

In the above-mentioned state, when the thumb is bent as similar to the index finger as shown in FIG. 1, the downward force effects on the optical fiber parts PF11, PF12 so that the connector members 25*a*, 25*b* are revolved by certain degree around the hinge 25*c*. Thus, the edge portions of the optical fiber parts PF11, PF12 are separated by the degree corresponding to the bending angle of the thumb. As a result, the infrared ray which is transmitted through the first optical fiber part PF11 and another reflected infrared ray which is reflected by the reflection plate 24 and then transmitted through the second optical fiber part PF12 are leaked at the connector members 25*a*, 25*b*. Such leakage of the infrared ray becomes larger, as the bending angle of the thumb (i.e., the opening degree of the connector 25) becomes larger. Due to such leakage of the infrared ray, the amount of the infrared ray radiated to the base of the phototransistor 28 is reduced, so that the turn-on degree of the phototransistor 28 becomes lower. Thus, the voltage level at the input of the A/D converter 31 becomes higher so that the A/D converter 31 supplies the digital signal SO of high level to the comparator 32.

Figure 4:
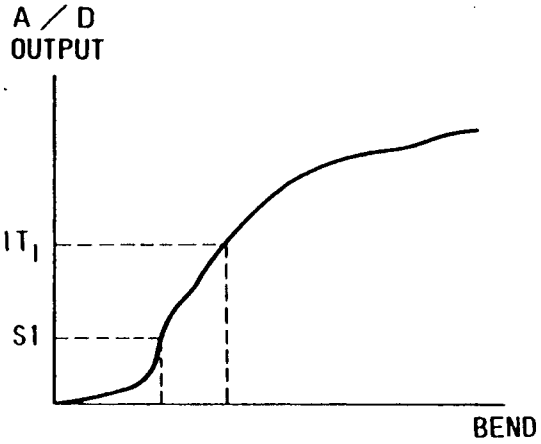
FIG. 4 is an output characteristic graph of an A/D converter shown in FIG. 2.
Figure 5A:
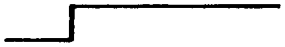
FIG. 5 shows a time chart for explaining the operation of the circuit as shown in FIG. 2.
Figure 5B:
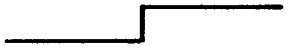
Figure 5C:
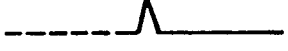

When the level of the digital signal SO increases and then reaches at the predetermined value S1 as shown in FIG. 4, the output level of the comparator 32 becomes high level. As described before, the delay circuit 35 delays the output signal of the comparator 32 by the predetermined delay time to thereby generate the key-on signal KON, and then the key-on signal KON is fed to the musical tone signal generating circuit 36. Thus, as shown in FIG. 5, at the leading edge of the key-on signal KON, the musical tone signal generating circuit 36 starts to generate the musical tone signal. In this case, this musical tone signal has the tone pitch which is assigned to the thumb in advance.

Meanwhile, in synchronism with the leading edge of the key-on signal KON, the register 33 fetches and stores the digital signal SO from the A/D converter 31. Thus, as shown in FIGS. 4 and 5, the digital signal SO at the time when the level of the key-on signal KON changes to the high level is outputted from the register 33 as the initial-touch signal IT1. This initial-touch signal IT1 is converted into another initial-touch signal IT2 by the characteristic converter 37. This initial-touch signal IT2 is fed to the musical tone signal generating circuit 36 wherein it is used to control the musical tone parameters such as the tone color, tone volume etc. of the musical tone signal which is started to be generated.

In response to the after-touch signal AT which is outputted from the characteristic converter 34, the musical tone signal generating circuit 36 controls the musical tone parameters such as the tone color, tone volume, musical effect etc. This after-touch signal AT is intermittently varied in response to the variation of the digital signal SO. Therefore, during the generation of the musical tone signal, by controlling the bending angle of the thumb to become larger or smaller such that the amount of the infrared ray radiated to the base of the phototransistor 28 is continuously varied, the musical parameters can be continuously controlled in response to the bending angle of the thumb.

During the generation of the musical tone signal, when the thumb is straightened, the state of the optical fiber PF1 is returned to the initial state as shown in FIG. 2. In this state, as described before, the level of the digital signal SO from the A/D converter 31 is low so that the level of the key-on signal KON is low, whereby the musical tone is attenuated and then it fades away.

Herein, the above description concerns the configuration and musical tone signal controlling operation of the musical tone control apparatus which includes the optical fiber PF1 and photocoupler PC1 attached at the thumb portion of the glove 10. The configuration and control operation of the musical tone control apparatus including the optical fiber PF2 and photocoupler PC2 attached at the index finger portion of the thumb 10 are similar to those of the optical fiber PF1 and photocoupler PC1, hence, the detailed description thereof will be omitted except for the difference between them. As such difference, the optical fiber PF2 is divided into three parts, i.e., first, second and third optical fiber parts PF21, PF22, PF23. Then, the connectors as similar to the foregoing connector 25 are provided between PF21, PF22 and PF22, PF23. Due to these two connectors, the amount of the infrared ray which is reflected, transmitted through the optical fiber PF2 and then radiated to the phototransistor 28 is reduced as compared to that for the thumb as a whole. Therefore, it is necessary to differ the conversion characteristic of the A/D converter 31, reference level (i.e., predetermined value S1) of the comparator 32 and conversion characteristic of the character converter 34 from those for the thumb. In addition, the tone pitch assigned to the musical tone signal generating circuit for the index finger is set different from the ton pitch assigned to the musical tone signal generating circuit 36 for the thumb.

(3) Modified example of optical fiber PF1

Figure 6:
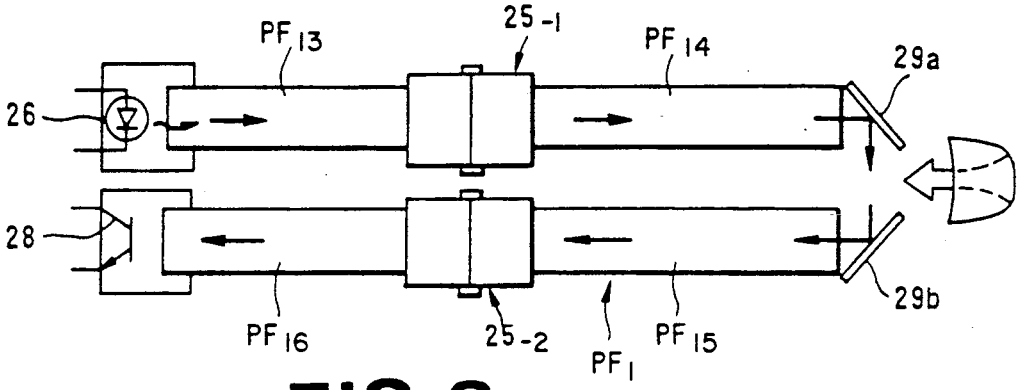
FIG. 6 is a plan view showing a modified example of an optical fiber to be used for the circuit shown in FIG. 2.

In the above-mentioned embodiment, the optical fiber PF1 is commonly used for transmitting the infrared ray forward and backward. In other words, the forward-optical-path and backward-optical-path are commonly provided in the optical fiber PF1. However, it is possible to modify this configuration such that both of the forward-optical-path and backward-optical-path are separately provided, as shown in FIG. 6. This modified example of the optical fiber as shown in FIG. 6 includes third to sixth optical fiber parts PF13 to PF16 each constructed as similar to the foregoing optical fiber parts PF11, PF12. The third optical fiber part PF13 is connected to the fourth optical fiber part PF14 in series via a connector 25-1 which is constructed as similar to the foregoing connector 25. The infrared ray emitted from the photodiode 26 is introduced into and then transmitted through PF13, 25-1, PF14. Then, this infrared ray emitted from the fourth optical fiber part PF14 is to be reflected by a reflection plate 29*a* which is provided at the outside edge of PF14 with the inclination of 45 degrees. Similarly, the fifth optical fiber part PF15 is connected to the sixth optical fiber part PF16 in series via a connector 25-2. This optical path configured by PF15, 25-2, PF16 is provided in parallel to the above optical path configured by PF13, 25-1, PF14. In addition, a reflection plate 29*b* is provided at the outside of the fifth optical fiber part PF15 with the inclination of 45 degrees. Therefore, this reflection plate 29*b* is provided rectangular to the reflection plate 29*a* with 90 degrees. Thus, the infrared ray emitted from PF14 and then reflected by the reflection plate 29*a* is further reflected by the reflection plate 29*b*, so that it is introduced into the fifth optical fiber part PF15. Thereafter, this infrared ray is transmitted through PF15, 25-2, PF16, and then it is radiated to the base of the phototransistor 28.

In short, in the above-mentioned example, the infrared ray emitted from the photodiode 26 is sequentially transmitted through PF13, 25-1, PF14, 29*a*, 29*b*, PF15, 25-2, PF16, and then it is finally radiated to the base of the phototransistor 28. In this example, the connectors 25-1, 25-2 work similar to the foregoing connector 25 so that it is possible to obtain the musical tone control signal corresponding to the bending angle of the thumb, index finger etc. from the phototransistor 28.

(4) Configuration and operation of other optical fibers PF3-PF5

Figure 7:
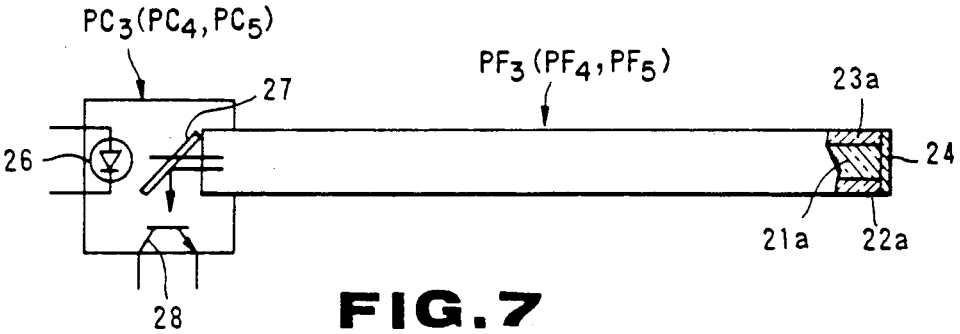
FIG. 7 is a partially broken view showing another optical fiber.

Now, description is back to FIG. 1, wherein the middle finger portion, fourth finger portion and little finger portion of the glove 10 respectively provide with optical fibers PF3, PF4, PF5 whose construction is different from that of PF1. In this case, each of these optical fibers PF3 to PF5 is also constructed by a core 21*a*, a clad 22*a* and a coating member 23*a*, as shown in FIG. 7. However, the difference between the refractive indexes of the core 21*a*, clad 22*a* is set smaller as compared to the difference between the refractive indexes of the foregoing core 21, clad 22 in the optical fiber PF1. In addition, the coating member 23*a* is made by the material, by which the inside light is partially leaked to the outside and it is partially absorbed. Therefore, when the light is transmitted through the core 21*a*, clad 22*a* and then reached at the coating member 23*a* in the state where the optical fiber PF3-PF5 is bent, the light is partially leaked and partially absorbed by the coating member 23*a*. In other words, the light-leakage-amount or light-absorption-amount in the unit length of the optical fiber PF3-PF5 is varied, so that the light-transmission-amount in the unit length of the optical fiber is varied in response to the bend of the optical fiber. Meanwhile, photocouplers PC3 to PC5 are constructed similar to the foregoing photocoupler PC1 as shown in FIG. 2. Further, the electric circuit as shown in FIG. 2 is connected to the photodiode and phototransistor of the photocoupler PC3-PC5.

When the middle finger, fourth finger or little finger is bent, the optical fiber PF3, PF4 or PF5 is bent so that the light-transmission-amount in the unit length of the optical fiber is varied in response to the bend of the optical fiber. Thus, the amount of the infrared ray to be received by the phototransistor 28 is varied in response to the bend of each finger. As a result, the musical tone control signal can be obtained from the collector of the phototransistor 28 of the photocoupler PC3-PC5. Therefore, the musical tone is controlled in response to the bend of the middle finger, fourth finger, little finger. In this case, the respective tone pitches are assigned to the middle finger, fourth finger, little finger.

Figure 8:
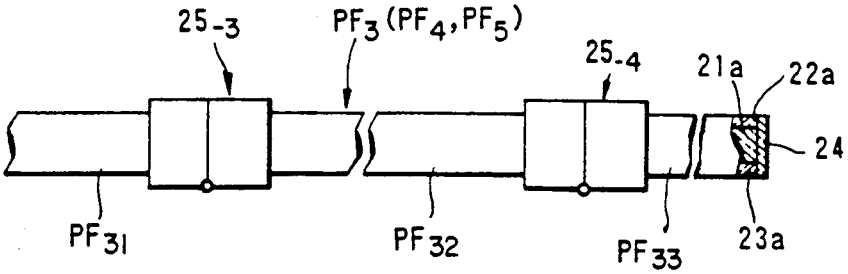
FIG. 8 is a partially broken view showing a modified example of the optical fiber shown in FIG. 7.

Meanwhile, the optical fiber PF3 etc. as shown in FIG. 7 can be divided into several parts PF31, PF32, PF33 as shown in FIG. 8. In this case, a connector 25-3 is provided between PF31, PF32 and another connector 25-4 is provided between PF32, PF33. In response to the bend of each finger, the light-transmission-amount in the unit length of the optical fiber PF3-PF5 is varied in accordance with the light-leakage-amount or light-absorption-amount of PF3-PF5 and light-leakage-amount of 25-3, 25-4.

(5) Effect of present embodiment

As described heretofore, the present embodiment detects the bending motions of the fingers by the optical fibers PF1 to PF5 which are provided in the glove 10, so that it is possible to obtain the musical tone control signal which corresponds to the bending motions of the fingers with great sensitivity. Thus, it is possible to control the musical tone signal with accuracy. In addition, the optical fiber PF1-PF5 has the fine and long construction, while the photocoupler PC1-PC5 is constructed by the semiconductor. Therefore, it is possible to reduce the size of the apparatus to be equipped to the glove 10, which allows the free movement of the finger.

[B] MODIFIED EXAMPLES OF THE PRESENT EMBODIMENT

The present embodiment can be modified as follows.

(1) In the glove 10 according to the present embodiment, the optical fibers as shown in FIGS. 2 and 6 are respectively mounted to the thumb portion and index finger portion; the optical fibers as shown in FIGS. 7 and 8 are mounted to the middle finger portion, fourth finger portion and little finger portion. However, it is possible to mount the optical fibers as shown in FIGS. 7 and 8 to the thumb portion and index finger portion. In addition, it is possible to mount the optical fibers as shown in FIGS. 2 and 6 to the middle finger portion, fourth finger portion and little finger portion.

(2) The present embodiment uses the infrared ray as the light to be transmitted. However, the optical fiber PF3 as show in FIG. 7 does not introduce the external light therein, so that it is possible to use the normal light (such as sunlight) other than the infrared ray. In this case, the photodiode 26 can be replaced by another element for emitting the light, and the phototransistor 28 can be replaced by another element for receiving the light. By tightly-closing the glove 10 wherein the optical fibers PF1 to PF5 are provided, it is possible to use the normal light for these optical fibers.

(3) The glove 10 of the present embodiment provides the optical fibers PF1 to PF5, photocouplers PC1 to PC5 from which the electric signals are transmitted via the leads 12, ... Instead, it is possible to only provide the optical fibers PF1 to PF5 in the glove 10, while the photocouplers PC1 to PC5 are provided within the electric circuits as shown in FIG. 2. In this case, the optical fibers are extended so that the glove 10 is connected to the electric circuits via these optical fibers.

(4) In the present embodiment, the photodiode 26 and phototransistor 28 are provided in the photocoupler PC1 which is coupled to one edge portion of the optical fiber PF1, so that the light is transmitted forward and backward in the bi-directional-optical-path within the optical fiber PF1. Instead, it is possible to modify the present embodiment such that the photodiode 26 is provided at one edge portion of the optical fiber while the phototransistor 28 is provided at another edge portion of the optical fiber. In this case, the light is transmitted in only one direction of the optical fiber.

Figure 9:
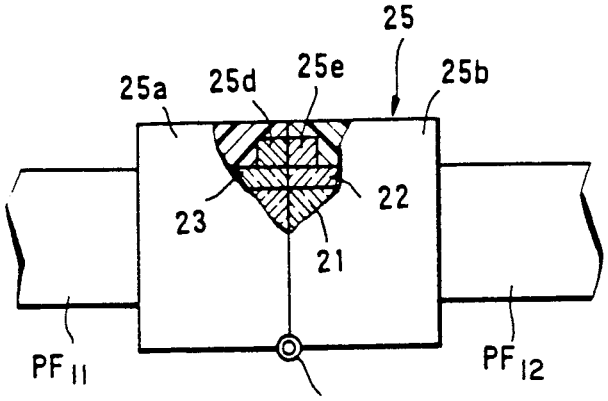
FIGS. 9, 10A, 10B are partially broken views showing modified examples of the connectors shown in FIGS. 2, 3, 6 and 8.
Figure 10A:
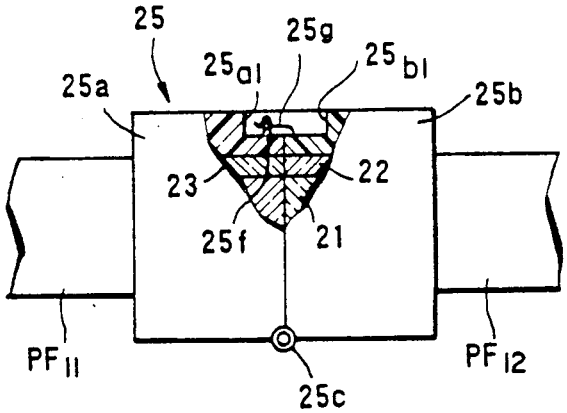
Figure 10B:
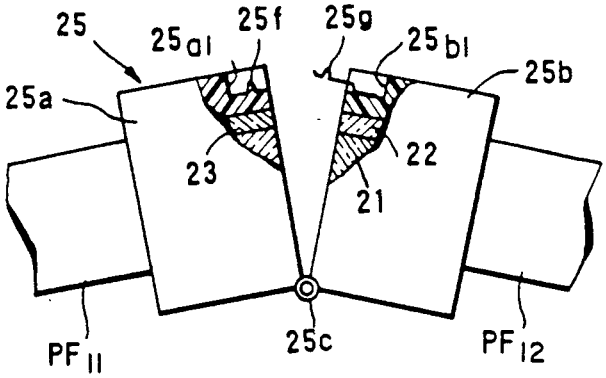

(5) The connector 25 can provides with a linking member by which the connector members 25*a*, 25*b* are joined together with relatively weak linking force. For example, as shown in FIG. 9, permanent magnets 25*d*, 25*e* are respectively buried in the connector members 25*a*, 25*b* such that they are in close contact with each other. The magnetic field (or field pole) of the permanent magnet 25*d* is set opposite to that of the permanent magnet 25*e*. Or, it is possible to form recess portions 25*a*1, 25*b*1 respectively at the connector members 25*a*, 25*b*, wherein these recess portions are in the condition of facing each other. Further, a projection 25*f* is formed at the recess portion 25*a*1, and a plate spring 25*g* whose one edge is fixed at a certain position of the recess 25*b*1. In the state where the connector 25 is closed so that the connector members 25*a*, 25*b* are in close contact with each other, another edge of the plate spring 25*g* is hooked on the projection 25*f*.

Due to the attracting magnetic force of the permanent magnets 25*d*, 25*e* or the elastic force of the plate spring 25*g*, the connector 25 is opened or closed with a click so that the performer can sense the clicking touch at his finger. Thus, the performer can sense the relation between the bending motion of his finger and musical tone control. For this reason, it is possible to control the generation of the musical tone and the application of the musical effect with ease.

(6) The present embodiment generates the key-on signal KON by merely comparing the digital signal SO from the A/D converter 31 with the predetermined value S1. However, it is possible to vary such predetermined value at the leading edge and trailing edge of the key-on signal KON (i.e., the key-on timing and key-off timing).

Figure 11:
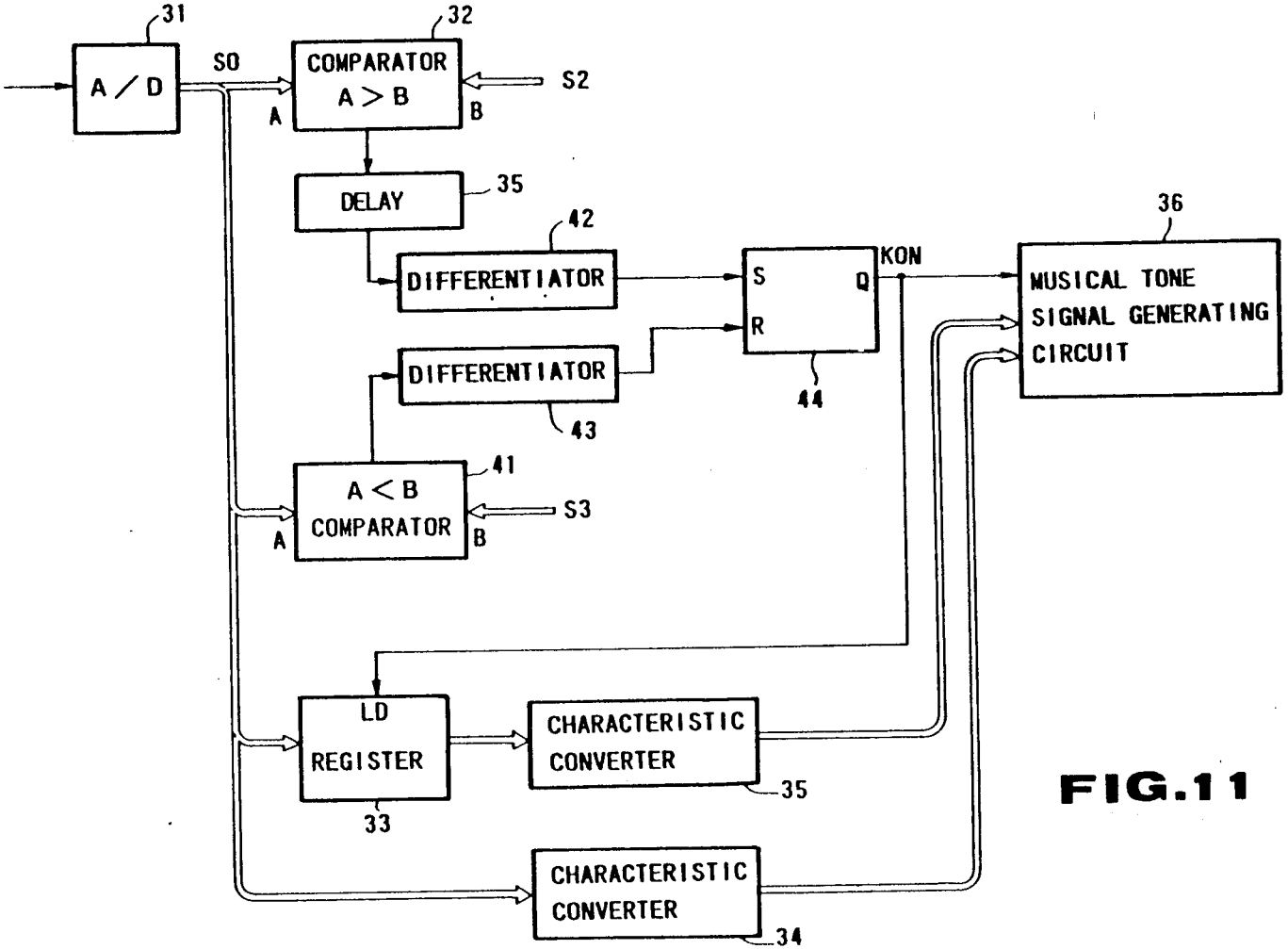
FIG. 11 is a block diagram showing a modified example of the circuit shown in FIG. 2.

In this modification, as shown in FIG. 11, a comparator 41 is additionally provided with the comparator 32. The comparator 32 compares the digital signal SO with a first predetermined value S2, while the comparator 41 compares the digital signal SO with a second predetermined value S3 whose level is slightly lower than S2. In contrast to the comparator 32, the comparator 41 outputs a high-level signal only while the digital signal SO is lower than the second predetermined value S3. The output of the comparator 32 is fed to a set input S of a flip-flop circuit 44 via the delay circuit 35 and a differentiator 42, while the output of the comparator 41 is fed to a reset terminal R of 44 via a differentiator 43. Then, the key-on signal KON is outputted from an output terminal Q of the flip-flop 44. Other circuit elements of FIG. 11 are similar to those of FIG. 2, hence, description thereof will be omitted.

According to the configuration as shown in FIG. 11, the key-on signal KON turns to the high level when the delay time of the delay circuit 35 is passed away after the digital signal S0 becomes higher than the first predetermined value S2. Then, when the digital signal SO becomes lower than the second predetermined value S3, the key-on signal KON turns to the low level. Since these values are in condition of $S2 > S3$, even if the level of the digital signal SO varies by relatively small value after it exceeds over S2, the level of the key-on signal KON does not flicker (or not frequently vary) between the high level and low level so that the high level of KON can be remained for a while. Thus, it is possible to obtain the stable key-on signal KON.

(7) In the present embodiment, the key-on signal KON, initial-touch signal IT and after-touch signal AT are formed based on the signal from the phototransistor 28. However, it is not necessary to form all of these signals KON, IT, AT. In addition, it is possible to form other kinds of signals.

(8) In the present embodiment, the performer puts on the glove 10 in which the optical fibers PF1 to PF5 are mounted. Instead, it is possible to equip the optical fibers PF1 to PF5 in socks, a loop-shaped supporter and the like which are attached to several parts of the human body such as the legs, elbows, knees etc. In other words, the musical tone control apparatus according to the present invention can be applied to any means to be attached to any part of the human body which can be bent.

Lastly, this invention may be practiced or embodied in still other ways without departing from the spirit or essential character thereof as described heretofore. Therefore, the preferred embodiment and its modifications described herein are illustrative and not restrictive, the scope of the invention being indicated by the appended claims and all variations which come within the meaning of the claims are intended to be embraced therein.

What is claimed is:

1. A musical tone control apparatus comprising:

(a) a light emitting element;

(b) a photo-conductive member, in which the transmitted amount of the light emitted from said light emitting element varies in response to a bend of said photo-conductive member;

(c) a light receiving element for receiving the light transmitted through said photo-conductive member;

(d) a mounting member to be mounted to a certain portion of a human body, said photo-conductive member being attached to said mounting member; and (e) control means for generating a musical tone control signal in response to the amount of the light received by said light receiving element, said control means including comparator means for comparing the amount of the received light to a predetermined threshold value, so that said control means generates said musical tone control signal based on said comparison of the amount of the received light and the predetermined threshold value.

2. A musical tone control apparatus according to claim 1 wherein said photo-conductive member is constructed by an optical fiber whose light-transmission or light-absorption varies in response to a bend thereof.

3. A musical tone control apparatus according to claim 1 wherein said musical tone control signal includes a signal indicating a start timing at which generation of a musical tone is started.

4. A musical tone control apparatus according to claim 1 wherein said control means further includes:

delay means for delaying an output of said comparator means; and bending velocity detecting means for detecting a bending velocity of said photo-conductive member based on a difference between two amounts of the received light corresponding to a delay time of said delay means, whereby said control means generates said musical tone control signal in response to said bending velocity detected by said bending velocity detecting means.

5. A musical tone control apparatus for use in connection with a musical tone generator, comprising:

(1) a light emitting element;

(2) a photo-conductive member, in which the transmitted amount of the light emitted from said light emitting element varies in response to a bend of said photo-conductive member, wherein said photo-conductive member comprises:

(a) a plurality of optical fibers some of which are connected together in series; and (b) a plurality of pairs of connector members, wherein two connector members in each one pair are respectively attached to edge portions of two optical fibers to be connected in series such that said two optical fibers can be revolved about an axis askew to its axial directions by a desirable degree, said two connector members opening or closing a connection between said edge portions of said two optical fibers in response to a force effected on said optical fibers;

(3) a light receiving element for receiving the light transmitted through said photo-conductive member; and (4) a mounting member to be mounted to a certain portion of a human body, in which at least said photo-conductive member is attached to said mounting member;

wherein a musical tone control signal may be generated in response to the amount of light received by said light receiving element.

6. A musical tone control apparatus according to claim 5 wherein a connecting member is provided at one part of said edge portions of said one pair of connector members so that the connection between said one pair of connector members can be obtained in an almost close state by said connecting member.

7. A musical tone control apparatus according to claim 6 wherein said connecting member is a hinge.

8. A musical tone control apparatus according to claim 5 further including click means for rapidly changing the force required for initially opening or completing the closing of said connector members, so that a click feeling is obtained when initially opening or completing the closing of said connector members.

9. A musical tone control apparatus according to claim 8 wherein said click means includes a magnet.

10. A musical tone control apparatus comprising:

(a) a photocoupler capable of emitting and receiving light, said photocoupler generating a signal corresponding to the received light thereof;

(b) first and second optical fibers which are to be connected in series;

(c) a connector which can be closed or opened by a desirable degree in response to a motion at a certain part of a human body, said first and second optical fibers being connected together in series by said connector, so that the amount of the light transmitted through said optical fibers is varied in response to said motion;

(d) a reflection member provided at one edge of said second optical fiber which is not connected to said connector; and (e) musical tone control means for generating a musical tone control signal based on an output signal of said photocoupler, said control means including comparator means for comparing the photocoupler output signal to a predetermined threshold value, so that said control means generates said musical tone control signal when a comparison result of said comparator means indicates that the photocoupler output signal exceeds said predetermined threshold value, wherein said photocoupler is coupled at one edge of said first optical fiber which is not connected to said connector, said photocoupler, said first optical fiber, said connector, said second optical fiber and said reflection member are connected in series so that the light emitted from said photocoupler is transmitted through said first optical fiber, said connector, said second optical fiber and then it is reflected by said reflection member, in which a reflected light is transmitted through said second optical fiber, said connector, said first optical fiber and then received by said photocoupler, said photocoupler outputting its output signal in response to the reflected light which is received by said photocoupler, wherein said musical tone control signal is varied in response to the output signal of said photocoupler based on said motion at the certain part of the human body.

11. A musical tone control apparatus according to claim 10 wherein said photocoupler further comprises:

(a) a photodiode for emitting the light;

(b) a phototransistor; and (c) guiding means for guiding the reflected light to said phototransistor so that said phototransistor can generate the signal corresponding to an amount of the reflected light.

12. A musical tone control apparatus according to claim 11 wherein said guiding means is a half mirror which is arranged such that the light emitted from the photodiode is introduced into the first optical fiber and the reflected light is guided to a base of the phototransistor.

13. A musical tone control apparatus according to claim 10 wherein said musical tone control means further comprises:

(a) an analog-to-digital converter for converting the output signal from said photocoupler into a digital signal whose value corresponds to said motion at the certain part of the human body;

(b) key-on signal generating means for generating a key-on signal based on said digital signal; and (c) means for generating an touch signal indicative of an initial-touch and/or an after-touch based on said digital signal and said key-on signal, wherein said key-on signal and said touch signal are used as said musical tone control signal for controlling musical parameters of a musical tone.

14. A musical tone control apparatus according to claim 10 wherein the certain part of the human body is an articulation of a finger so that the musical tone control signal is generated in response to a bending motion at the articulation of the finger.

15. A musical tone control apparatus comprising:

(a) a light emitting element;

(b) a photo-conductive member, in which the transmitted amount of the light emitted from said light emitting element varies in response to a bend of said photo-conductive member;

(c) a light receiving element for receiving the light transmitted through said photo-conductive member;

(d) a mounting member to be mounted to a certain portion of a human body, in which said photo-conductive member is attached to said mounting member; and (e) control means for generating a musical tone control signal in response to the amount of the light received by said light receiving element, said control means including first and second comparator means for respectively comparing the amount of the received light to first and second threshold values, wherein said control means generates said musical tone control signal when a comparison result of said first comparator means indicates that the amount of the received light is lower than said first threshold value or when a comparison result of said second comparator means indicates that the amount of the received light exceeds said second threshold value.

16. A musical tone control apparatus according to claim 15 wherein said musical tone control signal includes a signal indicating an end timing at which generation of a musical tone is ended.

17. A musical tone control apparatus according to claim 15 wherein said second threshold value is set lower than said first threshold value.

* * * * *